US009849471B2

(12) United States Patent
Lin et al.

(10) Patent No.: US 9,849,471 B2
(45) Date of Patent: Dec. 26, 2017

(54) COMBINATION SHOWERHEAD WITH DIAL BUTTON SWITCHING

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Jincan Zhang, Fujian (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 15/347,366

(22) Filed: Nov. 9, 2016

(65) Prior Publication Data

US 2017/0165685 A1 Jun. 15, 2017

(30) Foreign Application Priority Data

Dec. 11, 2015 (CN) ..... 2015 1 0922132

(51) Int. Cl.

| | |
|---|---|
| ***A62C 31/00*** | (2006.01) |
| ***B05B 1/16*** | (2006.01) |
| ***B05B 1/30*** | (2006.01) |
| ***B05B 9/01*** | (2006.01) |
| ***B05B 1/18*** | (2006.01) |
| ***B05B 12/00*** | (2006.01) |
| ***B05B 15/06*** | (2006.01) |

(52) U.S. Cl.

CPC ..... *B05B 1/1627* (2013.01); *B05B 1/16* (2013.01); *B05B 1/1636* (2013.01); *B05B 1/18* (2013.01); *B05B 1/3026* (2013.01); *B05B 9/01* (2013.01); *B05B 12/002* (2013.01); *B05B 15/061* (2013.01)

(58) Field of Classification Search

CPC ..... B05B 1/1627; B05B 1/1636; B05B 1/18; B05B 12/002; B05B 15/061; B05B 9/01; B05B 1/16; B05B 1/3026

USPC .... 239/443, 446, 447, 525, 530, 536, 581.1, 239/581.2, 582.1

See application file for complete search history.

(56) References Cited

U.S. PATENT DOCUMENTS 3,967,783 A * 7/1976 Halsted ..... B05B 1/1663 239/447
6,454,186 B2 * 9/2002 Haverstraw ..... B05B 1/044 239/443
8,066,204 B2 * 11/2011 Petrovic ..... B05B 1/1609 239/525

FOREIGN PATENT DOCUMENTS

CN 103521369 A 1/2014

* cited by examiner

*Primary Examiner* — Steven J Ganey
(74) *Attorney, Agent, or Firm* — Rabin & Berdo, P.C.

(57) ABSTRACT

A combination showerhead with dial button switching includes a fixing seat, two shower heads and a switch mechanism. The fixing seat has an inlet waterway and at least two diversion waterways. The switch mechanism includes a water diversion plate, a valve spool, a dial button and an elastic body. The water diversion plate is movably connected to the fixing seat and coupled to the inlet waterway and the diversion waterways, so that the plate rotates in a preset angle to switch the waterways. The valve spool is connected to the fixing seat and to the water diversion plate, so that the valve spool slides to drive the water diversion plate to rotate in a preset angle. The dial button has a cam portion and is rotatably connected to the fixing seat. The valve spool abuts against the periphery surface of the cam portion. The elastic body resets the valve spool.

11 Claims, 10 Drawing Sheets

COMBINATION SHOWERHEAD WITH DIAL BUTTON SWITCHING

FIELD OF THE INVENTION

The present invention relates to a combination shower head, especially to a combination shower head with the waterway switched by dial button.

BACKGROUND OF THE INVENTION

Existing combination shower head, for example a shower system combined with top sprayer and hand shower head applied by this applicant with publishing number CN103521369A, comprises a top sprayer with at least two outlet types and a hand shower head, the top sprayer is disposed with an inlet waterway connected to the water supply source and first diversion waterways corresponding to the outlet type one by one; the top sprayer is further disposed with a second diversion waterway, the hand shower head is connected to the second diversion waterway by a flexible pipe; the top sprayer is disposed with a switch mechanism, which is coupled to the inlet waterway, the first diversion waterway and the second diversion waterway to switch the waterways, the waterway switch can switch any diversion waterway to connect to the inlet waterway. The switch mechanism of the combination shower head is disposed at the top sprayer, the structure is not compact enough not it needs improvement.

SUMMARY OF THE INVENTION

The present invention is provided with a combination showerhead with dial button switching, which overcomes the disadvantages of the shower system combined with top sprayer and hand shower head of the existing technology.

The technical proposal of the present invention is that:

A combination showerhead with dial button switching, comprising a fixing seat (10) assembled to a support arm, a first shower head (20), a second shower head (30) and a switch mechanism (40), the first shower head (20) is assembled to the fixing seat (10); the fixing seat (10) is disposed with an inlet waterway (11) to connect to the support arm and at least two diversion waterways (12), the first diversion waterway is connected to the second shower head (30), the rest diversion waterways are connected to the first shower head (20); wherein the switch mechanism comprises:

a water diversion plate (41) movably connected to the fixing seat (10) and coupled to the inlet waterway (11) and the diversion waterways (12), the waterways are switched by rotating the water diversion plate (41) in a preset angle;

a valve spool (42) slidably connected to the fixing seat (10) and connected to the water diversion plate (41) in transmission way, the valve spool (42) slides forth and back to drive the water diversion plate (41) to rotate in a preset angle;

a dial button (43) rotatably connected to the fixing seat (10), the dial button (43) is disposed with a cam portion (431), the valve spool (42) abuts against the periphery surface of the cam portion (431), the dial button (43) swags to drive the valve spool (42) to slide; and an elastic body (44) used to reset the valve spool (42).

In another preferred embodiment, the switch mechanism (40) further comprises a fixing shaft (45) fixedly connected to the water diversion plate (41), the end of the valve spool (42), the end of the fixing shaft (45) and the fixing seat (10) are respectively disposed with ratchet, the ratchet at the end of the valve spool (42), the ratchet at the end of the fixing shaft (45) and the ratchet of the fixing seat (10) are coupled to make the transmission mechanism form an automatic pencil mechanism, the valve spool (42) slides forth and back to drive the fixing shaft (45) and the water diversion plate (41) to rotate in a preset angle.

In another preferred embodiment, the water diversion plate (41) is connected to the fixing seat (10) rotatably and movably with respect to the rotating axis, the elastic body (44) abuts between the water diversion plate (41) and the fixing seat (10).

In another preferred embodiment, the rear side of the fixing seat (10) is protruding with an assembly portion (13), the switch mechanism is assembled into the assembly portion (13); the dial button (43) is disposed with a handle (432), one end of the cam portion (431) is fixedly connected to the handle (432); the handle (432) is disposed at the outer side of the assembly portion (13), the cam portion (431) is rotatably connected to the assembly portion (13).

In another preferred embodiment, the second shower head (30) is a hand shower head, the outlet of the diversion waterway (12) connected to the second shower head (30) is corresponding to the periphery wall of the assembly portion (13), the hand shower head is connected to the outlet of the corresponding diversion waterway (12) by a flexible pipe (50), the lower portion of the front side of the fixing seat (10) is disposed with a connecting mechanism (14) to position the hand shower head.

In another preferred embodiment, the second shower head (30) is a fixing shower head, the fixing shower head is fixedly connected to the lower portion of the front side of the fixing seat (10).

In another preferred embodiment, the fixing seat (10) is disposed with a common portion (15) and two fork portions (16) arranged in fork way and fixedly connected to the common portion (15), the first shower head (20) is rotatably connected between two fork portions (16); a pipe section (21) is further provided arranged along the rotating axis of the first shower head (20), a portion of the diversion waterway (12) is connected to the first shower head (20) along the pipe section (21).

In another preferred embodiment, the assembly portion (13) is disposed at the rear side of the common portion (15).

In another preferred embodiment, the first shower head (20) is rotatably connected to the fixing seat (10), a damping mechanism (60) is disposed between the fixing seat (10) and the first shower head (20).

In another preferred embodiment, the damping mechanism (60) comprises a position seat (61), a rotating block (62) and a cam (63), the position seat (61) is disposed with at least two suspending sheets (64) arranged with space in the periphery direction, the at least two suspending sheets (64) form a revolution-like sleeve, the internal wall of the revolution-like sleeve is disposed with at least a gradient section with semi-diameter gradually varied, the cam (63) is disposed in the revolution-like sleeve and coupled to the gradient section, the rotating block (62) is sleeved on the outer side of the revolution-like sleeve, the cam (63) rotates and couples to the gradient section to make the friction force between the suspending sheets (64) and the rotating block (62) change to adjust the damping.

In another preferred embodiment, the fixing seat (10) is disposed with a common portion (150, the first shower head (20) is rotatably connected to the common portion (15); at least a pipe section is further provided along the rotating axis of the first shower head (20), a portion of the diversion waterway (12) is connected to the first shower head (20) along the pipe section (21).

Compared to the existing known technology, the technical proposal of the present invention has advantages:

1. the switch mechanism is disposed at the fixing seat, the first shower head can be applied with new designed shower head or existing shower head; the dial button rotates to drive the cam portion to rotate, the cam portion rotates to drive the valve spool to slide, the valve spool drives the water diversion plate to rotate so as to switch the waterways, on one hand, it is applied with the dial button to drive, the switch way is new and it is convenient for user to operate with one hand, on the other hand, the dial button is operated to drive the cam portion to rotate, the cam portion rotates to drive the valve spool, the valve spool drives the water diversion plate to rotate, it can configure the position of the dial button and the valve spool according to the fixing seat, the arrangement is reliable, the structure is compact.

2. the valve spool, the fixing shaft and the fixing seat are disposed with ratchet, the ratchets are coupled to form an automatic pencil mechanism, the valve spool pushes the fixing shaft to slide upwardly to rotate forwardly in half preset angle, the valve spool resets to drive the fixing shaft to slide downwardly to reset to rotate in half preset angle again, the valve spool slides forth and back and the fixing shaft and the water diversion plate rotate together in the preset angle, the arrangement is reliable, the structure is simple, the switch is stable and reliable, the operation is convenient.

3. the rear side of the fixing seat is protruding with an assembly portion, the switch mechanism is assembled in the assembly portion, the handle is disposed at the outer side of the assembly portion, the cam portion is rotatably connected to the assembly portion, the arrangement is reliable, the structure is compact, the appearance is attractive, it is convenient for user to operate.

4. The connecting structure to position the hand shower head is disposed at the lower portion of the front side of the fixing seat, it is convenient for user to catch or position the hand shower head, the appearance is attractive.

5. the fixing seat is disposed with a common portion and two fork portions, the first shower head is rotatably connected between two fork portions, the first shower head is rotatable that it is convenient for user to adjust the direction of the outlet of the first shower head as needed, it is convenient to use.

6. a damping mechanism is disposed between the fork portion of the fixing seat and the first shower head, it is convenient to position the shower head in the adjusted angle.

7. the cam is rotatably coupled to the gradient section to make the friction of the suspending sheets and the rotating block change, so that the damping is adjustable, the structure is simple and compact, the damping is convenient to adjust.

BRIEF DESCRIPTION OF THE DRAWINGS

The present invention will be further described with the drawings and the embodiments.

DETAILED DESCRIPTION OF THE EMBODIMENTS

Figure 1:
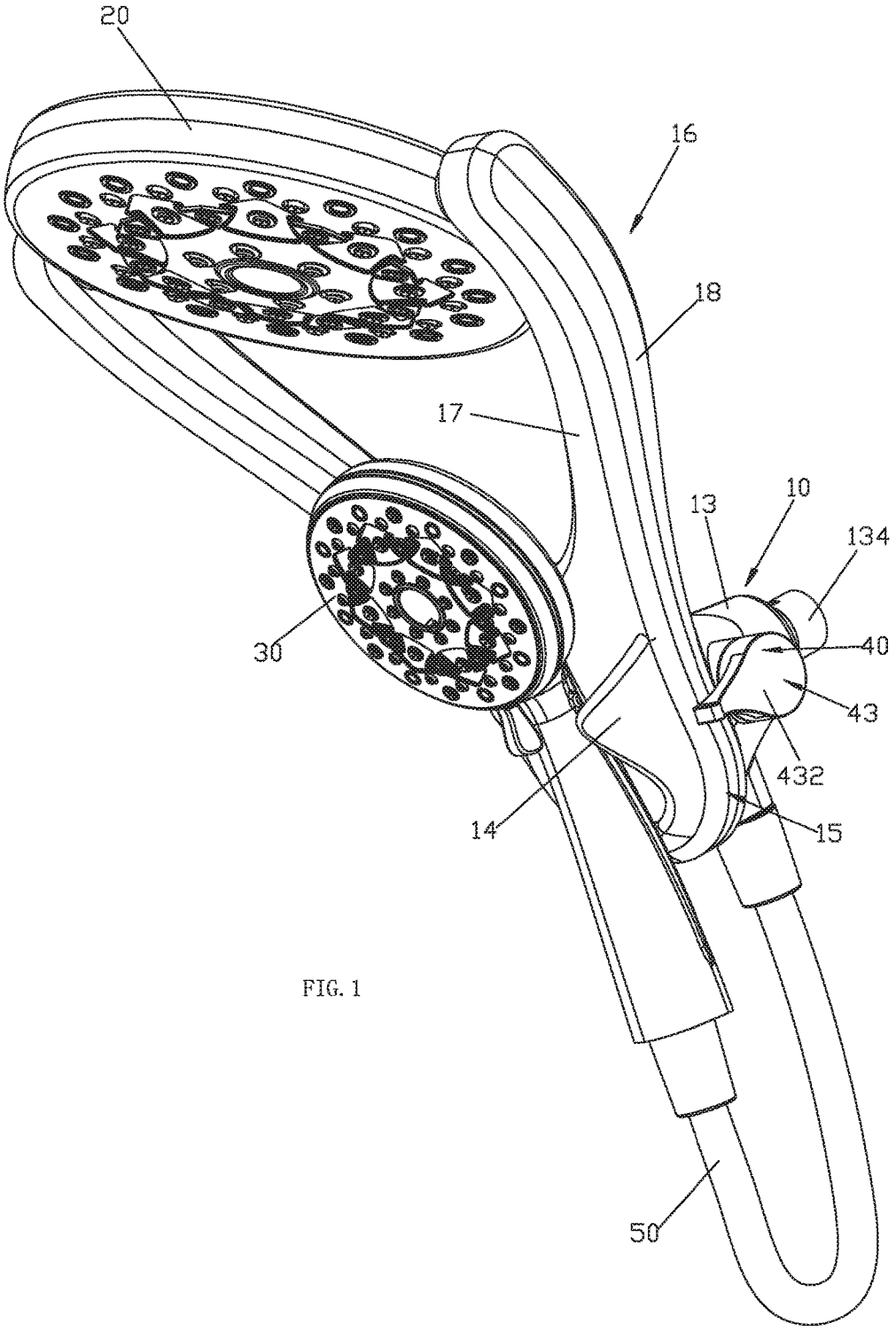
FIG. 1 illustrates a schematic diagram of the combination shower head of the first embodiment of the present invention.
Figure 2:
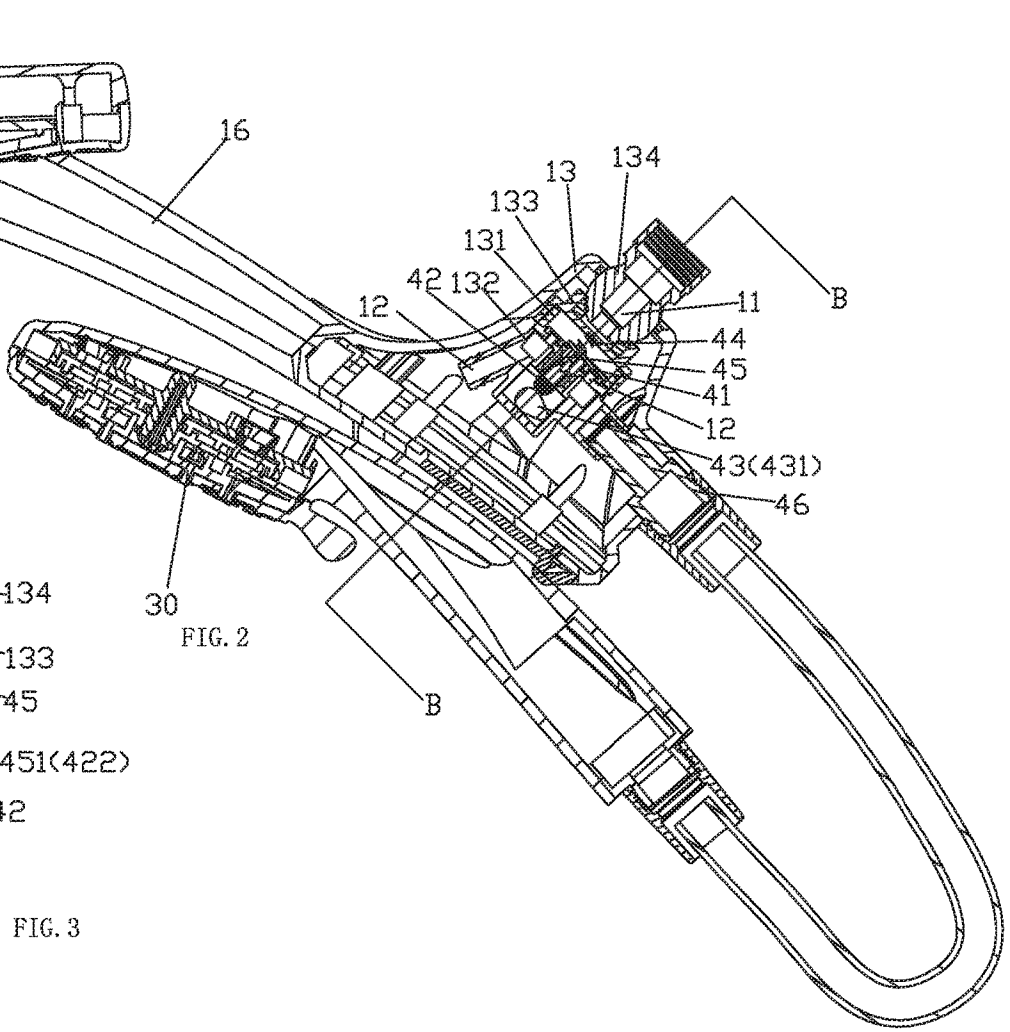
FIG. 2 illustrates a sectional diagram of the combination shower head of the first embodiment when water flows out of the first shower head.
Figure 3:
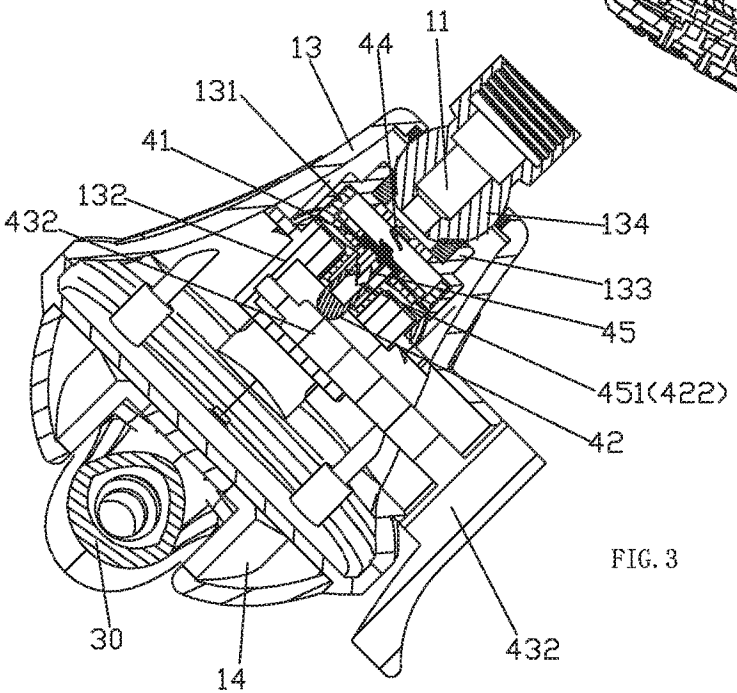
FIG. 3 illustrates a sectional diagram of FIG. 2 in B-B.
Figure 4:
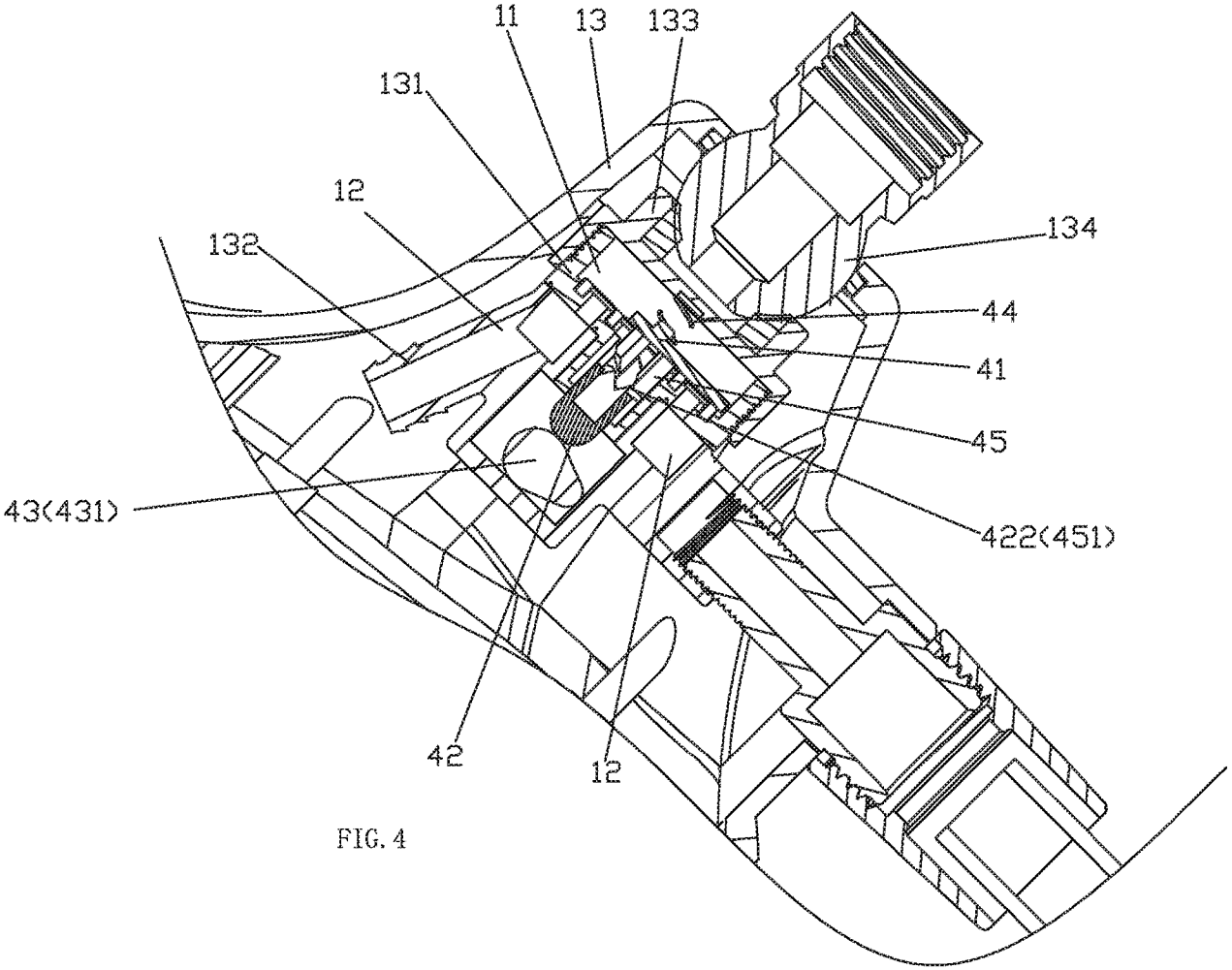
FIG. 4 illustrates an enlargement diagram of a portion of FIG. 2.
Figure 5:
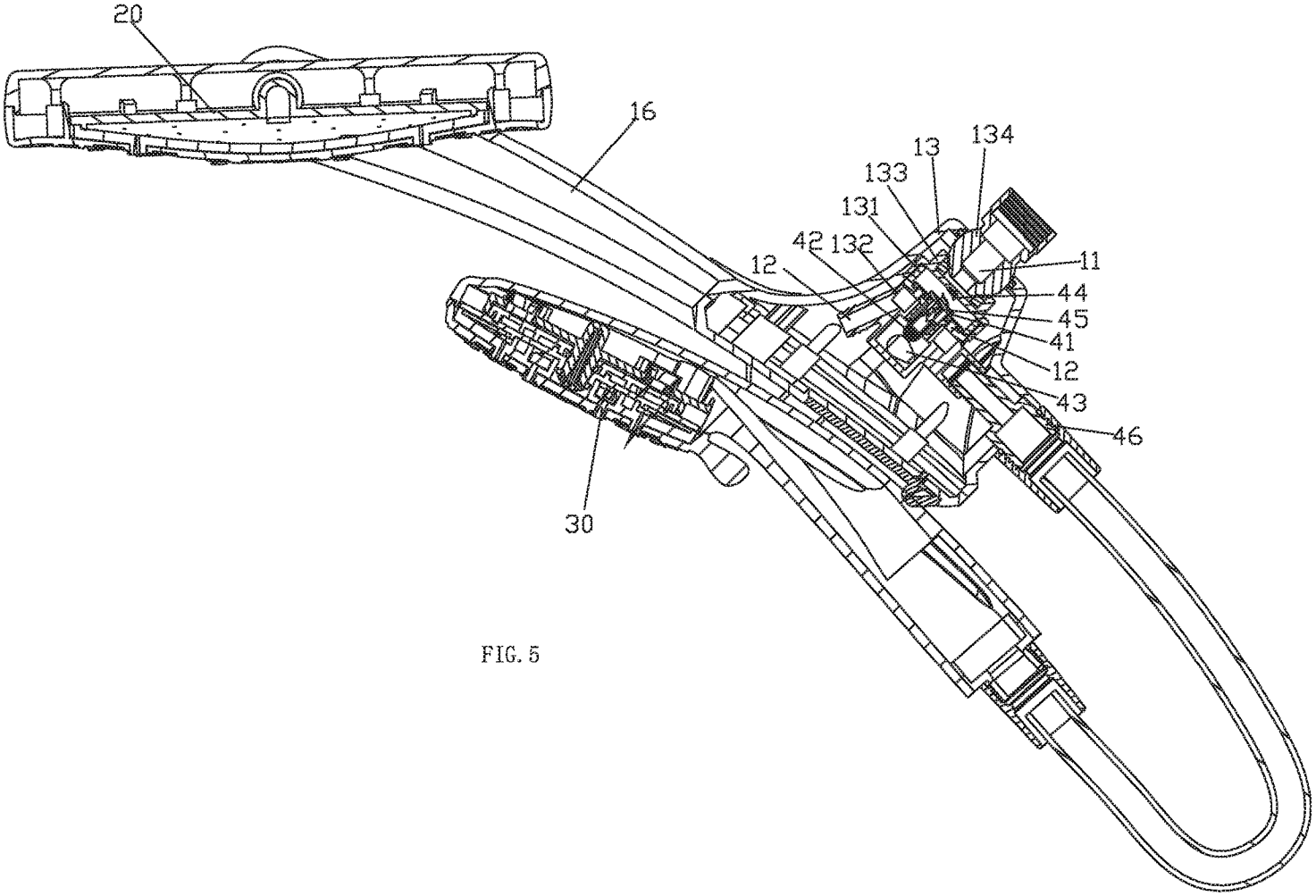
FIG. 5 illustrates of a sectional diagram of the combination shower head of the first embodiment when water flows out of the first shower head and the second shower head.
Figure 6:
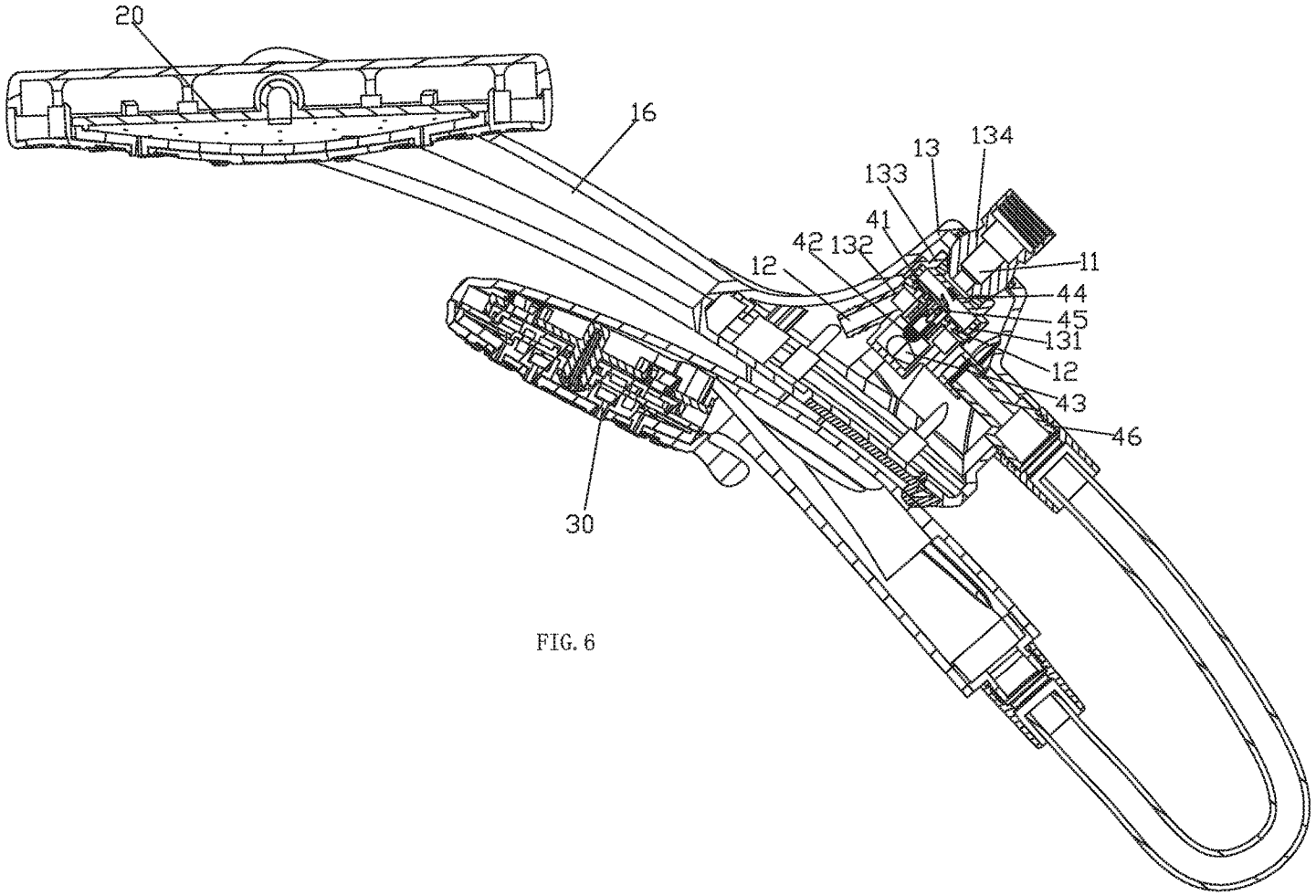
FIG. 6 illustrates a sectional diagram of the combination shower head of the first embodiment when water flows out of the second shower head.
Figure 7:
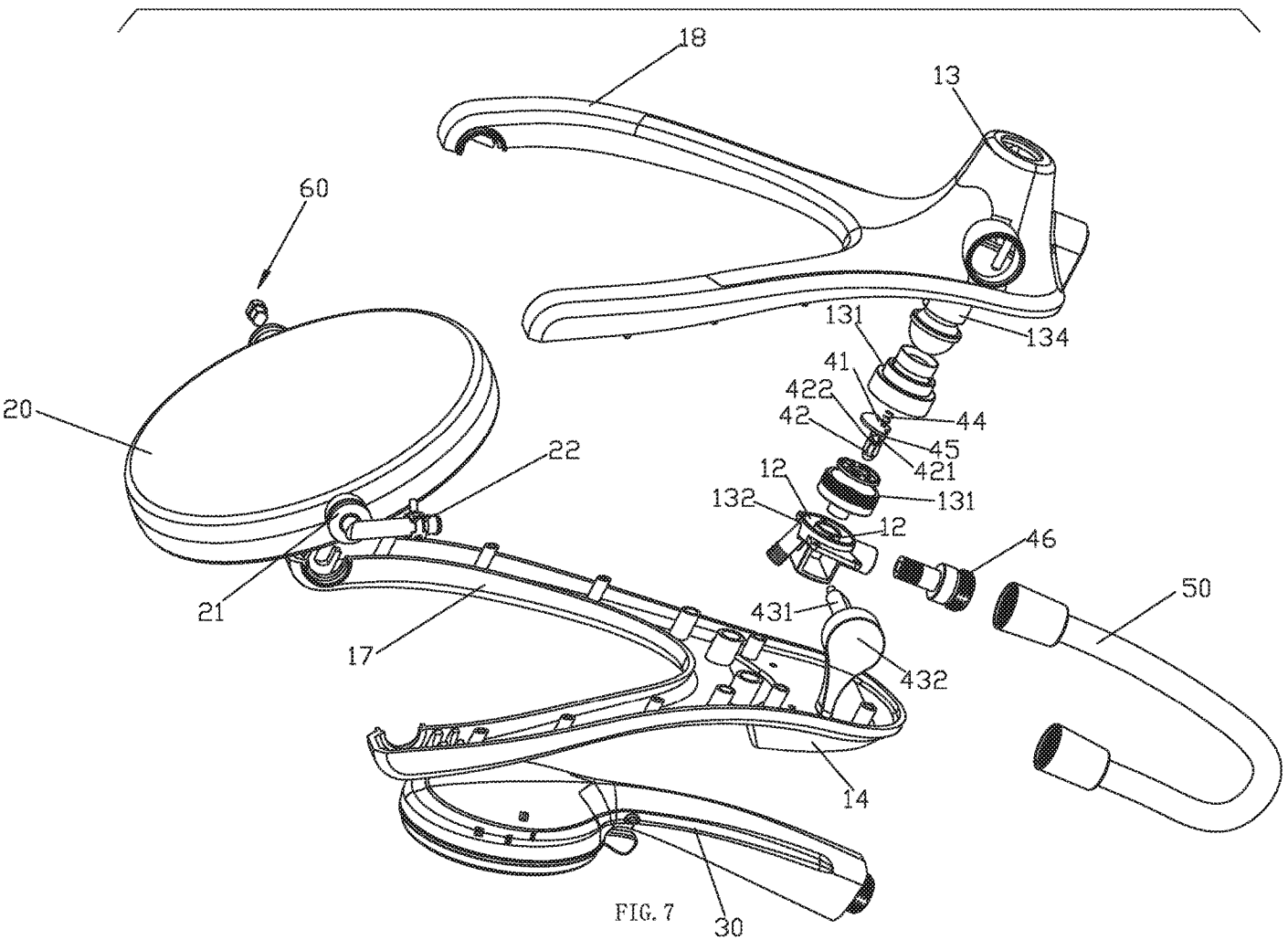
FIG. 7 illustrates an exploded and schematic diagram of the combination shower head of the first embodiment.
Figure 9:
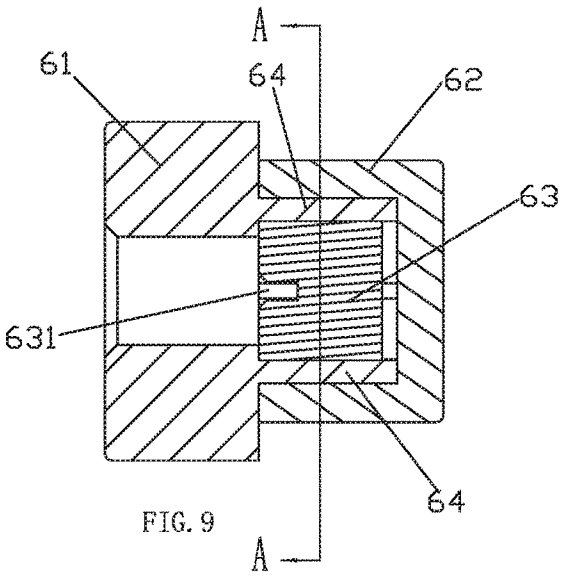
FIG. 9 illustrates a sectional diagram of the damping mechanism of the first embodiment.
Figure 8:
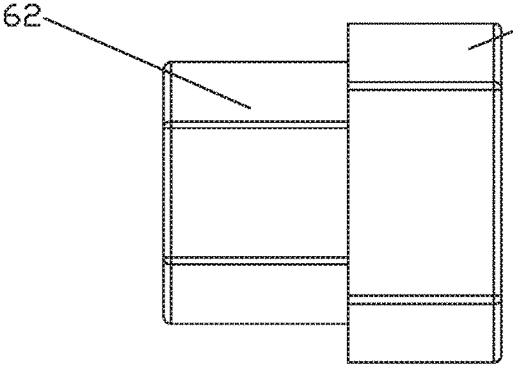
FIG. 8 illustrates a front view of the damping mechanism of the first embodiment.
Figure 10:
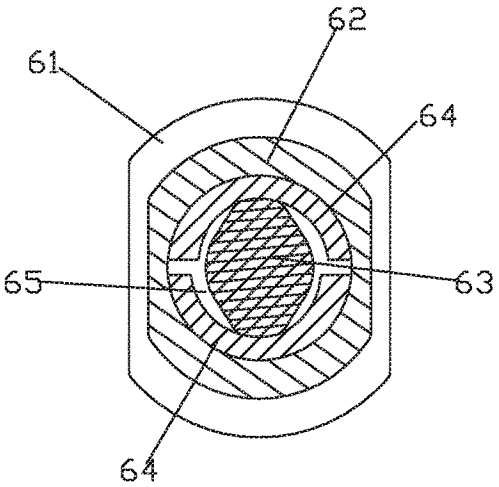
FIG. 10 illustrates a sectional diagram of FIG. 9 in A-A.

Please referring to FIGS. 1-10, the combination showerhead with dial button switching comprises a fixing seat 10, a first shower head 20, a second shower head 30 and a switch mechanism 40. The fixing seat 10 is assembled to the support arm, the support arm can be a water supply pipe fixed to the wall, the assembly can be fixedly connecting or universally connecting with ball structure. The first shower head 20 is an top spraying shower head or an overhead shower head assembled to the fixing seat 10, the first shower head 20 is disposed with a plurality of outlet functions with different water types, or it can be disposed with only an outlet function. The fixing seat 10 is disposed with an inlet waterway 11 connected to the support arm and at least two diversion waterways 12, one diversion waterway 12 is connected to the second shower head 30, the other diversion waterways 12 are connected to the first shower head 20; therein, if the first shower head 20 has only one outlet function, the fixing seat 10 has two diversion waterways 12; if the first shower head 20 has a plurality of outlet functions, 1. the fixing seat 10 has one diversion waterway, the first shower head and the second shower head are switched by the switch mechanism 40, the first shower head is further disposed with a switch mechanism to switch the outlet functions of the first shower head; 2. The rest diversion waterways 12 have same number as the outlet functions, the rest diversion waterways 12 are connected to the outlet functions one by one correspondingly, the second shower head and the outlet functions are switched by the switch mechanism 40.

The fixing seat 10 is disposed with a common portion 15 and two fork portions 16 arranged in fork way and fixedly connected to the common portion 15, the rear side of the common portion of the fixing seat 10 is protruding with an assembly portion 13. in this embodiment, the fixing seat 10 comprises a front cover 17 and a rear cover 18, the front cover 17 and the rear cover 18 are fixedly connected to form with the common portion and the fork portions, the rear cover is disposed with a through hole corresponding to the common portion, the periphery of the through hole extends to form above assembly portion 13 at the back side.

The switch mechanism 40 is assembled to the assembly portion 13 to switch the at least two diversion waterways to connect to the inlet waterway so as to switch the diversion waterways, or switch the diversion waterways and close all diversion waterways. The switch mechanism 40 comprises a water diversion plate 41, a valve spool 42, a dial button 43, an elastic body 44 and the fixing shaft 45. The water diversion plate 41 is rotatably and movably with respect to the rotating axis connected to the fixing seat 10 to couple to the inlet waterway 11 and the diversion waterway 12 to achieve waterway switch by rotating in a preset angle; if the water diversion plate is disposed with water holes, the water holes align with the water diversion holes to achieve connecting, the waterway is closed by staggering of the previous two, if the water diversion plate is fan-shaped, the water is closed by fully blocking of the water diversion plate, the water is flowing by not fully blocking or not blocking of the water diversion plate. The valve spool 42 is slidably connected to the assembly portion of the fixing seat 10 along the rotating axis of the water diversion plate, so that the valve spool 42 slides forth and back to drive the water diversion plate 41 to rotate in a preset angle. The dial button 43 is rotatably connected to the fixing seat 10, the rotating axis of the dial button is vertical to the sliding direction of the valve spool, the dial button 43 is disposed with a cam portion 431, the first end of the valve spool 42 abuts against the periphery surface of the cam portion 431, so that the dial button 43 swags to drive the valve spool 42 to slide. The fixing shaft 45 is fixedly connected to the water diversion plate 41. The elastic body 44 is used to reset the valve spool. Preferred, the end portion of the valve spool abutting against the cam portion is disposed to be segment shaped so as to drive the dial button to reset.

In detailed, the assembly portion is disposed with a throughout hole passing through inside and outside, the dial button 43 is further disposed with a handle 432, one end of the cam portion 431 is fixedly connected to the handle 432, preferred, this end is fixedly connected to the handle by a column section, the other end is a column section, two column sections are rotatably connected to the assembly portion, the column section is rotatably passing through the throughout hole and then is fixedly connected to the handle 432 to position the handle 432 at the outer side of the assembly portion 13 for user to dial, the cam portion 431 is rotatably disposed to the assembly portion 13. The end of the valve spool 42 and the end of the fixing shaft 45 are disposed respectively with ratchet 422, 451, the fixing seat is also disposed with ratchet, the ratchet 422 at the end of the valve spool 42, the ratchet 451 at the end of the fixing shaft 45 and the ratchet of the fixing seat are coupled to each other to form an automatic pencil mechanism, that is to say, the valve spool slides forwardly to drive the fixing shaft 45 to move upwardly and rotate forwardly in half preset angle, the valve spool slides backwardly to drive the fixing shaft 45 to move downwardly to reset and rotate forwardly in half preset angle again, the valve spool 42 pushes the fixing shaft 45 and the water diversion plate 41 to move upwardly together and rotate forwardly in half preset angle, the valve spool 42 moves back to drive the fixing shaft 45 and the water diversion plate 41 to move downwardly together and rotate forwardly in half preset angle; the elastic body 44 abuts between the side surface of the fixing shaft at the back side of the water diversion plate 41 and the assembly portion of the fixing seat, so that when the water diversion plate moves upwardly, the elastic body is compressed to store energy, the elastic body releases energy to drive the water diversion plate to move downwardly so as to drive the valve spool to move backwardly. The dial button 43 swags to the first direction to drive the cam portion 431 to rotate in the first direction, the cam portion 431 abuts against the valve spool 42 to drive the valve spool 42 to slide towards the water diversion plate 41, the valve spool 42 pushes the fixing shaft 45 and the water diversion plate to move upwardly, during the movement, the fixing shaft and the water diversion plate rotate forwardly in half preset angle, at the same time, the elastic body stores energy; when the dial button is released, the elastic body releases the energy to push the water diversion plate and the valve spool to move downwardly, the valve spool and the dial button reset, the water diversion plate and the fixing shaft rotate forwardly in half preset angle again.

In this preferred embodiment, the fixing seat further comprises a fixing base 131 fixed to the assembly portion, a water diversion body 132 and a connecting seat 133, the connecting seat 133 is coupled to a ball joint 134 to assemble to the support arm. A water diversion chamber is formed between the connecting seat and the fixing base 131, the water diversion chamber forms a portion of the inlet waterway 11. The water diversion plate 41 is movably connected to the fixing base 131; the elastic body 44, such as a spring, is disposed between the water diversion plate and the connecting seat 133, so that the water diversion plate 41 is closely contacted with the bottom surface of the fixing base 131. The fixing base 131 is disposed with at least two water diversion holes, which respectively form a portion of the at least two diversion waterways 12, the water diversion plate rotates to switch the water diversion holes to connect to the water diversion chamber, so as to achieve the switching of the diversion waterway to connect to the inlet waterway. The water diversion body 132 is fixedly connected to the fixing base 131 and is disposed with at least two water passages, the at least two water passages are respectively connected to the at least two water diversion holes, they respectively form a portion of the at least two diversion waterways 12. The fixing base 131 is disposed with a throughout assembly hole, the fixing shaft is coupled to pass through the assembly hole to make the fixing shaft be able to rotate and move along the rotating axis, the valve spool is slidably connected in the assembly hole, the ratchet of the fixing seat is disposed at the assembly hole; the water diversion body is concaved with an assembly groove connected to the assembly hole, the cam portion of the dial button is disposed in the assembly groove, the valve spool passes through the assembly hole and abuts against the water diversion body.

The first shower head 20 is rotatably connected between the two fork portions. A pipe section 21 is disposed along the rotating axis of the first shower head 20, one end of the pipe section 21 is connected to the first shower head 20, the other end is fixedly disposed with a water pipe 22, the pipe section 21 and the water pipe 22 are coupled to a L-shaped structure, the rest diversion waterways are connected to the first shower head along the water pipe 22 and the pipe section 21, if there is only one rest diversion waterway, the water pipe 22 and the pipe section 21 directly form a portion of the diversion waterway.

A damping mechanism 60 is disposed between one fork portion 16 of the fixing seat 10 and the first shower head 20. In detailed, the damping mechanism 60 comprises a position seat 61, a rotating block 62 and a cam 63, the position seat 61 comprises a base and two suspending sheets 64 arranged with space in the periphery direction and fixedly connected to the position seat 61, two suspending sheets 64 form a revolution-like sleeve (a slot is formed between two suspending sheets 64), the external wall of the revolution-like sleeve is the revolution surface, the semi-diameter of the internal wall of the revolution-like sleeve is gradually changed to form a gradient section, the cam 63 is disposed in the revolution-like sleeve and it abuts against the gradient section; the rotating block 62 is sleeved on the outer side of the revolution-like sleeve, the cam 63 rotates and couples to the gradient section to make the pressure between the suspending sheets 64 and the rotating block 62 varied so that the friction force therebetween changes, thus adjusting the damping. Preferred, the base passes through the cam to make one end face of the cam exposed, the exposed end face is disposed with a coupling groove 631 for user to use tool to drive the cam to rotate. The position seat 61 and the rotating block 62 are respectively fixedly connected to two relatively rotating components, for example, the fork portion and the first shower head.

In this embodiment, the second shower head 30 is a hand shower head. The front side of the common portion is disposed with a connecting structure 14 for the positioning of the hand shower head, the connecting mechanism 14 is, for example, a socket, but not limited to this, it can be a magnetic attraction structure. The diversion waterway 12 connected to the second shower head 30 further comprises a joint 46 fixedly connected to one water passage of the water diversion body, the port of the joint 46 forms the outlet, the joint passes through the assembly portion 13, the hand shower head is connected to the outlet of the corresponding diversion waterway 12 by a flexible pipe 50.

Figure 11:
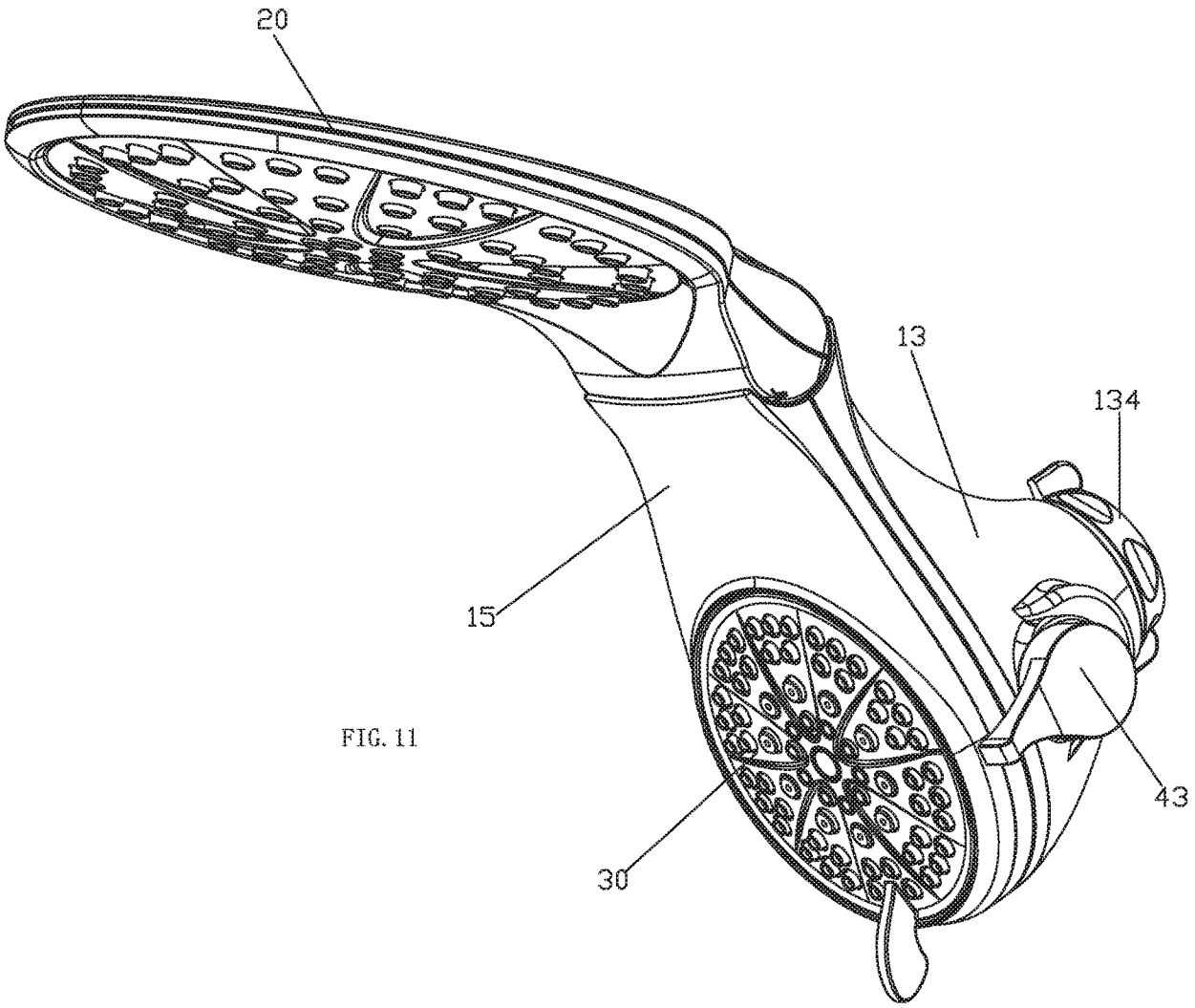
FIG. 11 illustrates a schematic diagram of the combination shower head of the second embodiment.
Figure 12:
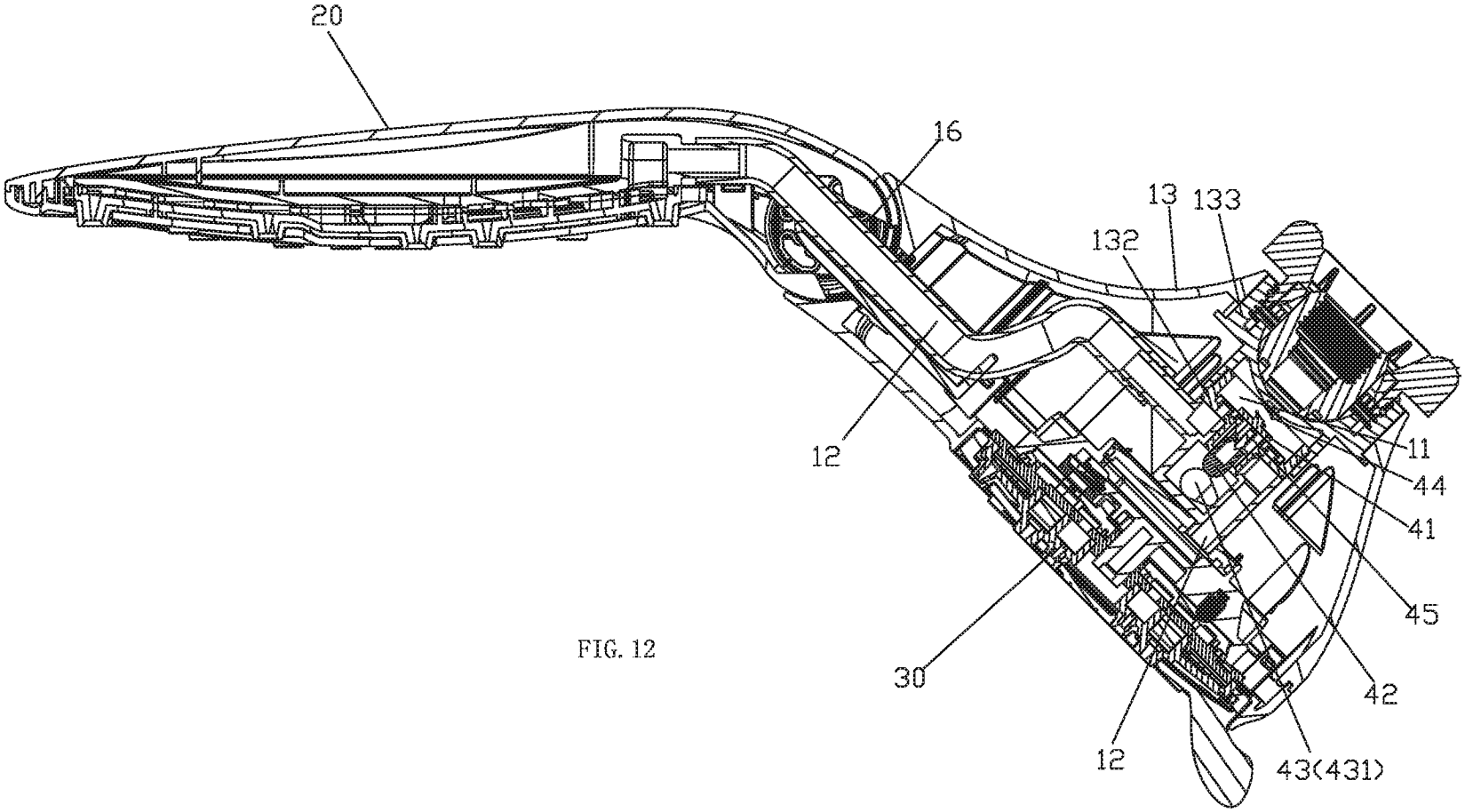
FIG. 12 illustrates a sectional diagram of the combination shower head of the second embodiment.
Figure 13:
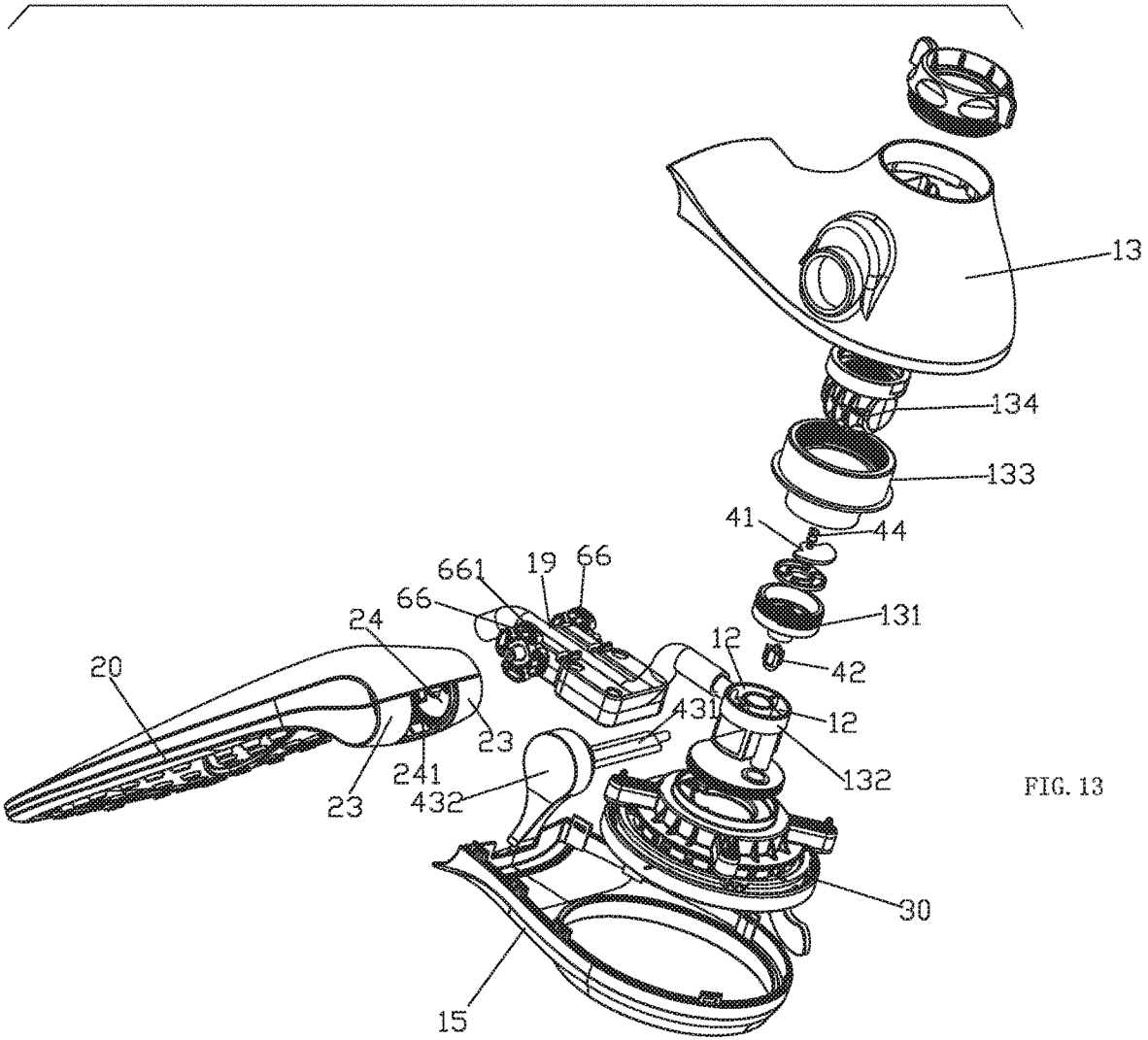
FIG. 13 illustrates an exploded and schematic diagram of the combination shower head of the second embodiment.

In another embodiment, please referring to FIGS. 11-13, this embodiment differs from the previous embodiment in that: the second shower head 30 is a fixing shower head, the fixing shower head is fixedly connected to the lower portion of the front side of the common portion of the fixing seat 10, the water passage of the water diversion body is directly connected to the fixing shower head; the common portion is protruding with a protruding portion 19, the first shower head is protruding with two protruding ears 23, the protruding portion 19 is disposed between the two protruding ears, the first shower head is connected to the protruding portion by a pivot shaft, the pivot shaft is hollow for the diversion waterway to connect to the first shower head; the damping mechanism is disposed between the protruding portion and the connecting portion, the damping mechanism comprises a connecting portion 66 fixedly connected to the protruding portion 19, there can be one connecting portion or more than one, if there is only one connecting portion, the connecting portion has a column surface or a column portion, if there are more than one connecting portion, the connecting portions are arranged with space in the periphery direction, each connecting portion has a column portion, the column portion is protruding with damping teeth 661 arranged with space, the protruding ear 23 is concaved with a groove 24, which is sleeved on the connecting portion, the internal wall of the groove is protruding with damping teeth 241 arranged with space, the damping teeth couple to achieve damping.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A combination showerhead with dial button switching, comprising a fixing seat (10) assembled to a support arm, a first shower head (20), a second shower head (30) and a switch mechanism (40), the first shower head (20) is assembled to the fixing seat (10); the fixing seat (10) is disposed with an inlet waterway (11) to connect to the support arm and at least two diversion waterways (12), the first diversion waterway is connected to the second shower head (30), the other diversion waterways are connected to the first shower head (20); wherein the switch mechanism comprises:

a water diversion plate (41) movably connected to the fixing seat (10) and coupled to the inlet waterway (11) and the at least two diversion waterways (12), the at least two diversion waterways are switched by rotating the water diversion plate (41) in a preset angle;

a valve spool (42) slidably connected to the fixing seat (10) and connected to the water diversion plate (41) in a transmission way, the valve spool (42) slides forth and back to drive the water diversion plate (41) to rotate in the preset angle;

a dial button (43) rotatably connected to the fixing seat (10), the dial button (43) is disposed with a cam portion (431), the valve spool (42) abuts against a periphery surface of the cam portion (431), the dial button (43) swags to drive the valve spool (42) to slide; and an elastic body (44) used to reset the valve spool (42).

2. The combination showerhead with dial button switching according to claim 1, wherein the switch mechanism (40) further comprises a fixing shaft (45) fixedly connected to the water diversion plate (41), the end of the valve spool (42), the end of the fixing shaft (45) and the fixing seat (10) are respectively disposed with ratchets, the ratchet at the end of the valve spool (42), the ratchet at the end of the fixing shaft (45) and the ratchet of the fixing seat (10) are coupled to make a transmission mechanism form an automatic pencil mechanism, the valve spool (42) slides forth and back to drive the fixing shaft (45) and the water diversion plate (41) to rotate in the preset angle.

3. The combination showerhead with dial button switching according to claim 1, wherein the water diversion plate (41) is connected to the fixing seat (10) rotatably and movably with respect to the rotating axis, the elastic body (44) abuts between the water diversion plate (41) and the fixing seat (10).

4. The combination showerhead with dial button switching according to claim 1, wherein the rear side of the fixing seat (10) is protruding with an assembly portion (13), the switch mechanism is assembled into the assembly portion (13); the dial button (43) is disposed with a handle (432), one end of the cam portion (431) is fixedly connected to the handle (432); the handle (432) is disposed at the outer side of the assembly portion (13), the cam portion (431) is rotatably connected to the assembly portion (13).

5. The combination showerhead with dial button switching according to claim 4, wherein the second shower head (30) is a hand shower head, an outlet of the first diversion waterway (12) connected to the second shower head (30) is corresponding to the periphery wall of the assembly portion (13), the hand shower head is connected to the outlet of the corresponding first diversion waterway (12) by a flexible pipe (50), the lower portion of the front side of the fixing seat (10) is disposed with a connecting mechanism (14) to position the hand shower head.

6. The combination showerhead with dial button switching according to claim 4, wherein the second shower head (30) is a fixing shower head, the fixing shower head is fixedly connected to the lower portion of the front side of the fixing seat (10).

7. The combination showerhead with dial button switching according to claim 4, wherein the fixing seat (10) is disposed with a common portion (15) and two fork portions (16) arranged in fork way and fixedly connected to the common portion (15), the first shower head (20) is rotatably connected between two fork portions (16); a pipe section (21) is further provided arranged along the rotating axis of the first shower head (20), a portion of the other diversion waterway (12) is connected to the first shower head (20) along the pipe section (21).

8. The combination showerhead with dial button switching according to claim 7, wherein the assembly portion (13) is disposed at the rear side of the common portion (15).

9. The combination showerhead with dial button switching according to claim 4, wherein the first shower head (20) is rotatably connected to the fixing seat (10), a damping mechanism (60) is disposed between the fixing seat (10) and the first shower head (20).

10. The combination showerhead with dial button switching according to claim 9, wherein the damping mechanism (60) comprises a position seat (61), a rotating block (62) and a cam (63), the position seat (61) is disposed with at least two suspending sheets (64) arranged with space in the periphery direction, the at least two suspending sheets (64) form a revolution-like sleeve, the internal wall of the revolution-like sleeve is disposed with at least a gradient section with semi-diameter gradually varied, the cam (63) is disposed in the revolution-like sleeve and coupled to the gradient section, the rotating block (62) is sleeved on the outer side of the revolution-like sleeve, the cam (63) rotates and couples to the gradient section to make the friction force between the suspending sheets (64) and the rotating block (62) change to adjust the damping.

11. The combination showerhead with dial button switching according to claim 4, wherein the fixing seat (10) is disposed with a common portion (150, the first shower head (20) is rotatably connected to the common portion (15); at least a pipe section is further provided along the rotating axis of the first shower head (20), a portion of the other diversion waterway (12) is connected to the first shower head (20) along the pipe section (21).

* * * * *